US006543819B2

(12) United States Patent
Hakimain

(10) Patent No.: US 6,543,819 B2
(45) Date of Patent: Apr. 8, 2003

(54) NECKTIE KNOTTER

(76) Inventor: John Hakimain, 810 2nd Avenue 43rd St., New York, NY (US) 10017

( * ) Notice: Subject to any disclaimer, the term of this patent is extended or adjusted under 35 U.S.C. 154(b) by 307 days.

(21) Appl. No.: 09/823,227

(22) Filed: Apr. 2, 2001

(65) Prior Publication Data

US 2003/0020280 A1 Jan. 30, 2003

(51) Int. Cl.[7] ..... A01D 59/04

(52) U.S. Cl. ..... 289/2; 289/1.2; 289/1.5; 289/18.1

(58) Field of Search ..... 289/1.2, 1.5, 2, 289/4, 17, 18.1; 2/144, 148, 152.1, 153, 154; 223/82, 85, 111, DIG. 1, DIG. 3, DIG. 4; 434/258, 260, 400, 433

(56) References Cited

U.S. PATENT DOCUMENTS 2,300,051 A * 10/1942 Lind ..... 289/1.5
4,401,328 A * 8/1983 Yamada et al. ..... 289/2
5,209,382 A * 5/1993 Chang ..... 223/85
5,562,456 A * 10/1996 Cianciotto ..... 289/17
5,601,318 A * 2/1997 Rusing ..... 289/17
6,015,172 A * 1/2000 Williams et al. ..... 289/2
6,120,068 A * 9/2000 DiPietro ..... 289/17
6,171,317 B1 * 1/2001 Jackson et al. ..... 289/17

* cited by examiner

*Primary Examiner*—Danny Worrell
*Assistant Examiner*—Gary L. Welch

(57) ABSTRACT

A necktie knotter having a plurality of paired retractable slidable pegs movably mounted within horizontal slots and a hook having upper and lower members forming a hook cradle therebetween. The plurality of paired retractable slidable pegs and hook are connected to and controlled by a motor having a microchip and software to control automatically tying a necktie knot.

4 Claims, 8 Drawing Sheets

NECKTIE KNOTTER

BACKGROUND OF THE INVENTION

1. Field of the Invention

The present invention relates to a necktie knotter. More particularly, the present invention relates to an automatic necktie knotter which facilitates a user tying a necktie.

2. Description of the Prior Art

Numerous innovations for necktie knotters have been provided in the prior art that are described as follows. Even though these innovations may be suitable for the specific individual purposes to which they address, they differ from the present invention as hereinafter contrasted.

In U.S. Pat. No. 6,015,172, Titled, Necktie support for tying, invented by Williams, et al. comprises a device for supporting a necktie during tying to facilitate the formation of a useful and aesthetically pleasing knot so that the necktie may be removed from the device and worn includes a base member, an arrangement for supporting a necktie including first and second support members mounted to the base member and projecting outwardly therefrom, and an arrangement for preventing necktie movement in a direction towards the first and second support members which is mounted to the base member at a vertical spacing from the upper support members. The present invention also provides a method for tying a necktie on the device which includes draping a necktie over the upper support members and, using the lower support members, forming a slip knot in the necktie which is drawn tight against the lower support member.

In U.S. Pat. No. 5,601,318, Titled, Necktie knot tying device, invented by Rusing comprises a necktie knot tying tool having an elongate body with a handle at one end and a tie finishing portion at the other end. A raised projection extends outwardly from the tool between the two ends for placement beneath the final loop formed when tying a necktie. The projection has a textured surface as does the tie finishing portion to limit slippage of the tie over those portions of the tool. An indent in the top of the raised projection aids in the formation of a crease in the tie below the knot.

In U.S. Pat. No. 4,401,328, Titled, Electrically operated fishline tier, invented by Yamada, et al. comprises an electrically operated, hand-held tier for tying a length of fishline to a fishhook comprises a tying wheel mounted rotatably on a bearing boss for rotation in one direction. The tying wheel has an anchoring member secured thereto for holding releasably one end portion of the fishline after the fishline has been passed through the bearing boss. One end of a fishhook opposite to its sharp point is adapted to be received in coaxial relation to the bearing boss and has a number of turns of the fishline formed thereon when the tying wheel is rotated several times thereabout. The rotation of the tying wheel is effective to form a knot on the fishline which is necessary to secure the fishhook to the fishline.

In U.S. Pat. No. 2,300,051, Titled, Method of and mechanism for tying knots, invented by Lind comprises an improved method of and apparatus for tying knots and more particularly for uniting threads or strands of such material as woolen yam.

The above patented inventions differ from the present invention because they fail to describe or claim at least one combination of the following features depicted in the present invention housing slots, left and right retractable movable pegs, and hook having a hook upper member and hook lower member forming a hook cradle member therebetween.

Numerous innovations for necktie knotters have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a necktie knotter. More particularly, the present invention relates to an automatic necktie knotter which facilitates a user tying a necktie.

The types of problems encountered in the prior art are racks and other manual devices for tying neckties but lack automation.

In the prior art, unsuccessful attempts to solve this problem were attempted namely: apparatuses for manually forming a necktie knot.

Innovations within the prior art are rapidly being exploited in the field of automation of manual tasks.

The present invention went contrary to the teaching of the art which describes and claims manual tying devices.

The present invention solved a long felt need for an automated necktie knotter.

The present invention produced unexpected results namely: less wear and tear on ties as compared to manually tying thereby increasing life of tie and reducing lifetime costs of apparel to user.

Accordingly, it is an object of the present invention to provide a necktie knotter having a housing, left pegs, right pegs, hook, and motor.

More particularly, it is an object of the present invention to provide the housing having a housing crest, housing bottom, housing cover, housing rear, housing front, housing first slot, housing second slot, housing third slot, housing fourth slot, housing fifth slot, housing sixth slot, housing left, housing right, and housing top.

In keeping with these objects, and with others which will become apparent hereinafter, one feature of the present invention resides, briefly stated, in the left and right pegs having a first left peg, first right peg, second left peg, second right peg, third left peg, third right peg, fourth left peg, fourth right peg, fifth left peg, and fifth right peg.

When the hook is designed in accordance with the present invention comprises a gook upper member, hook lower member, and hook cradle member.

In accordance with another feature of the present invention, the motor has a motor cord.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—necktie knotter (10)
12—housing (12)
12A—housing crest (12A)
12B—housing bottom (12B)

12C—housing cover (12C) 12CA—housing cover hinge (12CA)
12D—housing rear (12D)
12F—housing front (12F)
12G—housing first slot (12G)
112H—housing second slot (12H)
121—housing third slot (121)
12J—housing fourth slot (12J)
12K—housing fifth slot (12K)
12L—housing sixth slot (12L)
12M—housing left (12M)
12R—housing right (12R)
12T—housing top (12T)
14AL—first left peg (14AL)
14AR—first right peg (14AR)
14BL—second left peg (14BL)
14BR—second right peg (14BR)
14CL—third left peg (14CL)
14CR—third right peg (14CR)
14DL—fourth left peg (14DL)
14DR—fourth right peg (14DR)
14EL—fifth left peg (14EL)
14ER—fifth right peg (14ER)
16—hook (16)
16A—hook upper member (16A)
16B—hook lower member (16B)
16C—hook cradle member (16C)
18—motor (18)
18A—motor cord (18A)
20—tie (20)
20L—tie left side (20L)
20R—tie right side (20R)
20RA—tie right side knot point (20RA)
22—optical reader (22)
24—roller (24)
26—keypad (26)
METHOD OF FORMING A NECKTIE KNOT

DESCRIPTION OF THE PREFERRED EMBODIMENT

Figure 1:
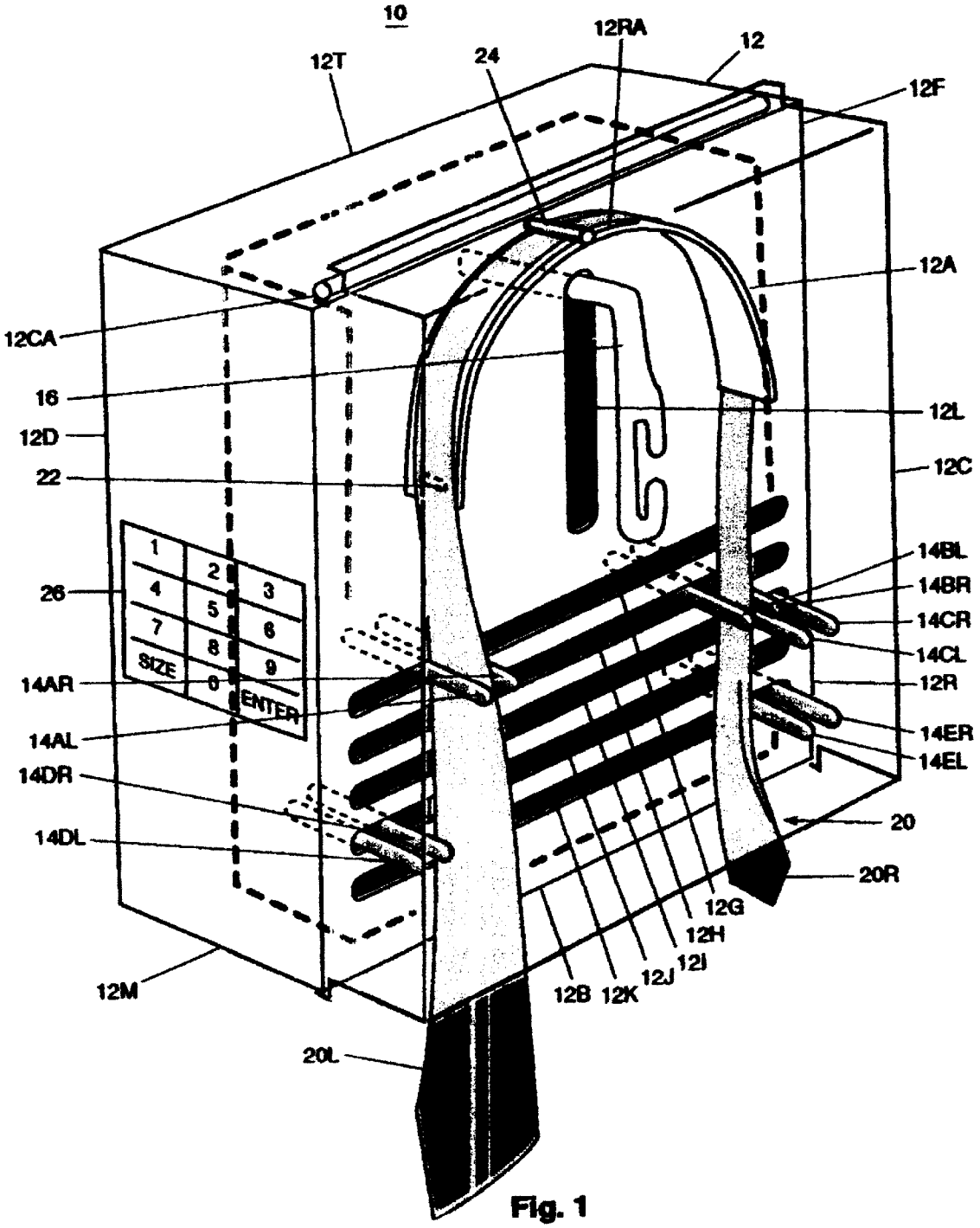
FIG. 1 is a top left perspective view of a necktie knotter (10) exhibiting a tie (20) being knotted therein by placing (112) a tie right side knot point (20RA) of a tie (20) over the housing crest (12A) and thereafter first grasping (114) a tie right side (20R) of a tie (20) between the second left peg (14BL) and second right peg (14BR).
Figure 2:
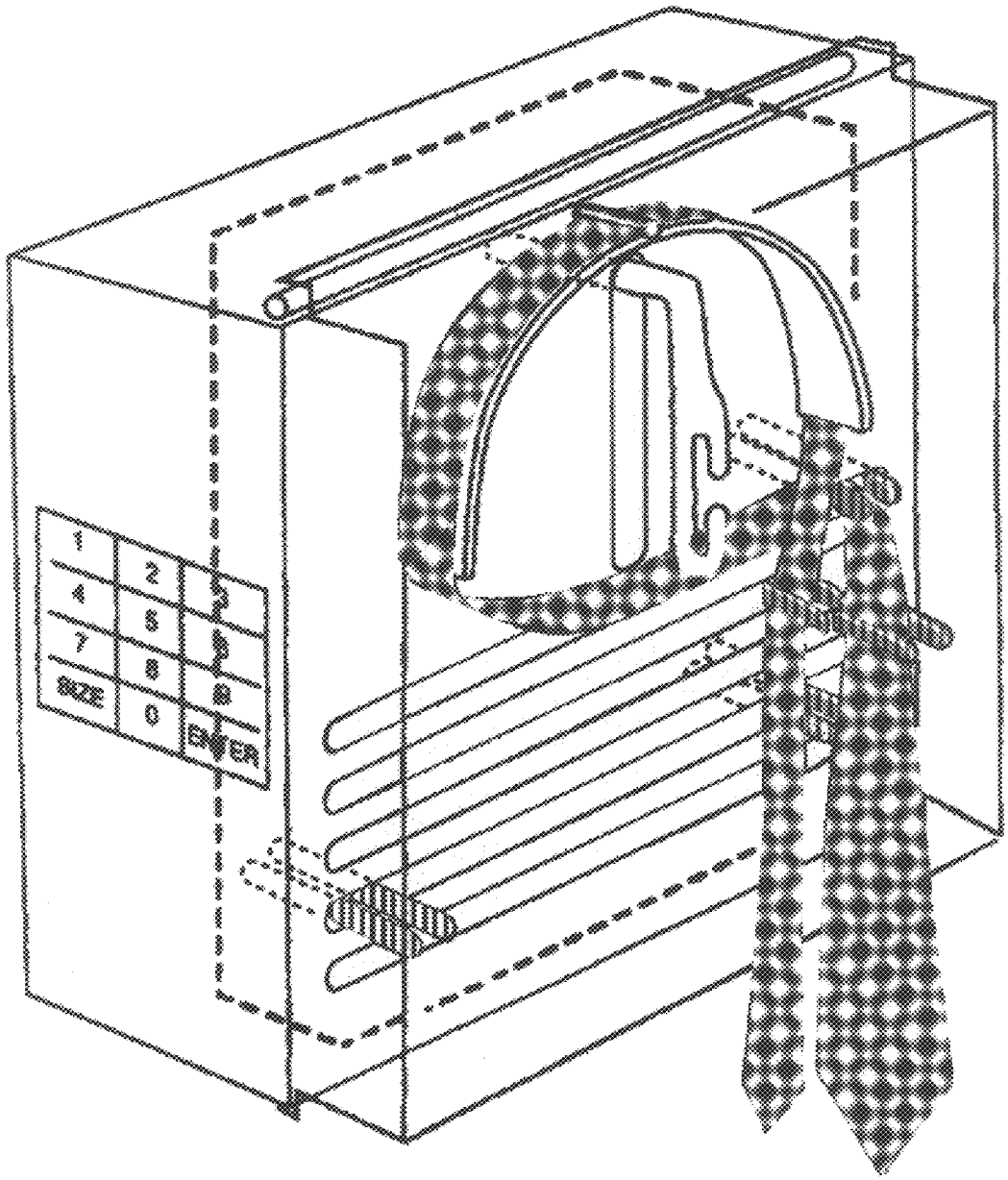
FIG. 2 is a top left perspective view of a necktie knotter (10) exhibiting a tie (20) being knotted therein by first sliding (116) the tie right side (20R) to the left under and past a tie left side (20L) and thereafter second grasping (118) a tie left side (20L) between the first left peg (14AL) and first right peg (14AR) and moving to the right over the tie right side (20R) and thereafter third grasping (120) the tie left side (20L) between the third left peg (14CL) and the third right peg (14CR).
Figure 3:
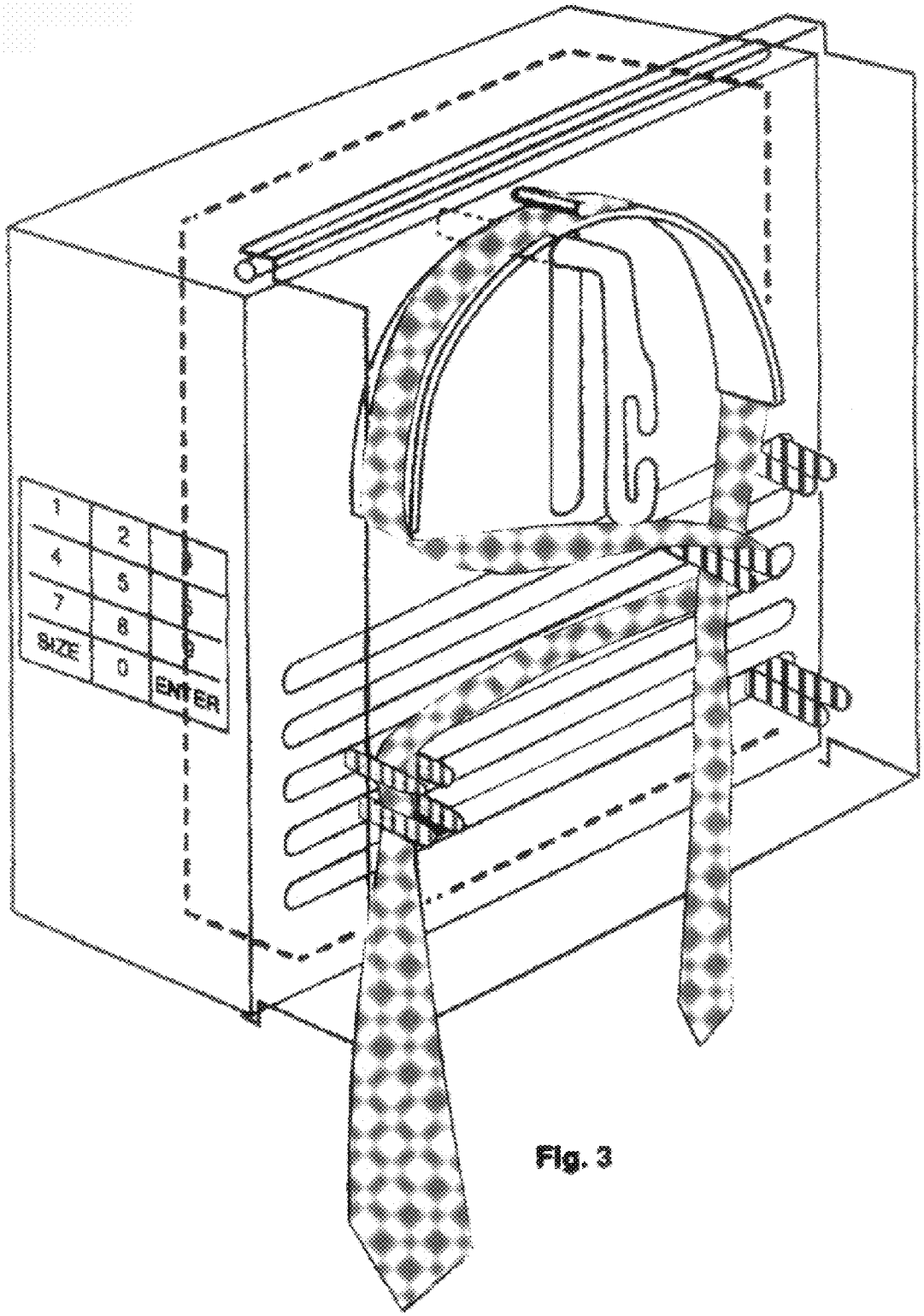
FIG. 3 is a top left perspective view of a necktie knotter (10) exhibiting a tie (20) being knotted therein by first retracting (122) the third left peg (14CL) and the third right peg (14CR) moving the tie left side (20L) inwardly close to the housing front (12F) while concurrently releasing the tie left side (20L) from the first left peg (14AL) and first right peg (14AR).
Figure 4:
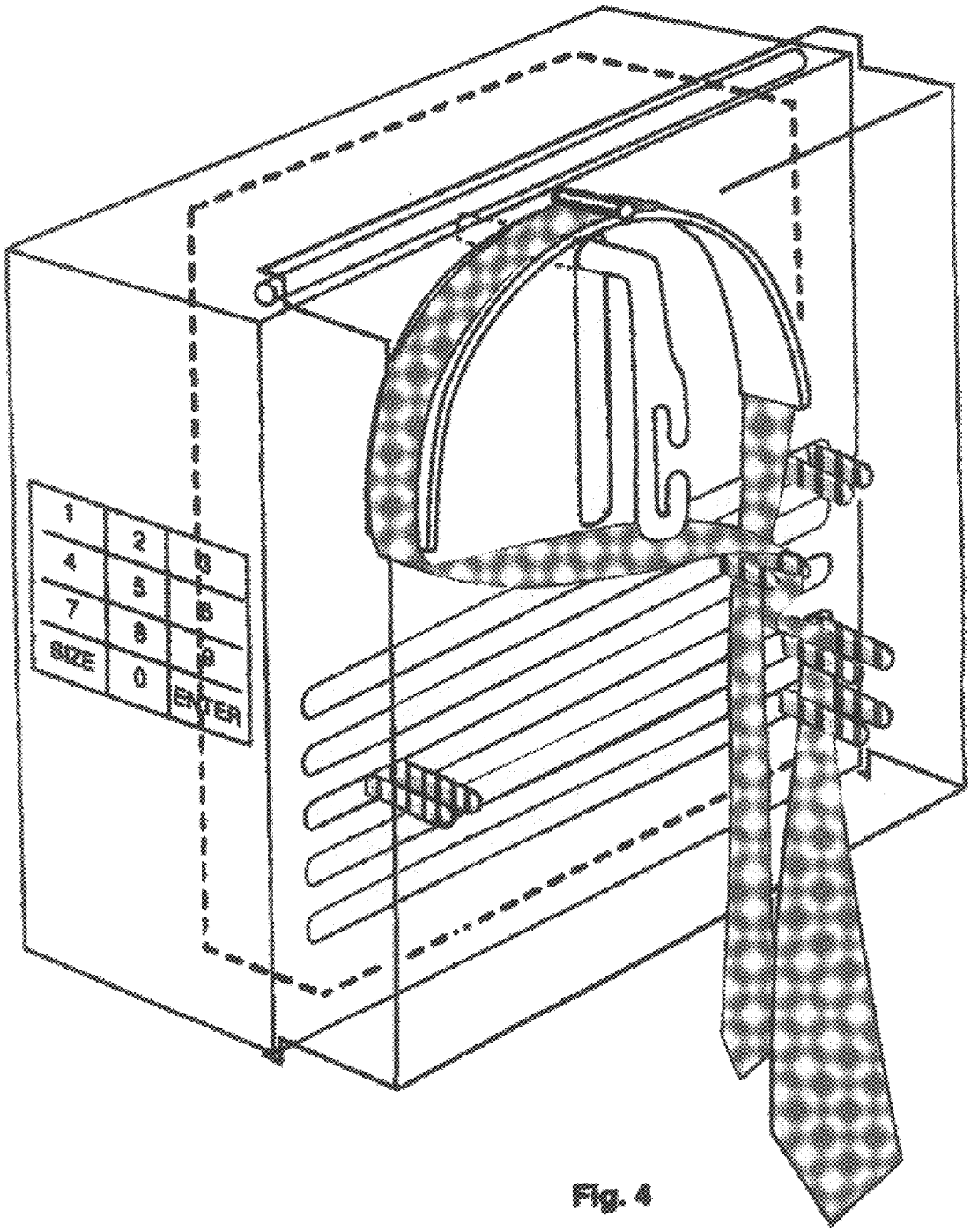
FIG. 4 is a top left perspective view of a necktie knotter (10) exhibiting a tie (20) being knotted therein by first moving (124) the third left peg (14CL) and the third right peg (14CR) to the left positioning the tie left side (20L) over and behind the tie right side (20R) and thereafter fourth grasping (126) the tie left side (20L) between the fourth left peg (14DL) and the fourth right peg (14DR) and thereafter first extending (128) the fourth left peg (14DL) and the fourth right peg (14DR) moving the tie left side (20L) outwardly from the housing front (12F) while concurrently releasing the tie left side (20L) from the third left peg (14CL) and third right peg (14CR).
Figure 5:
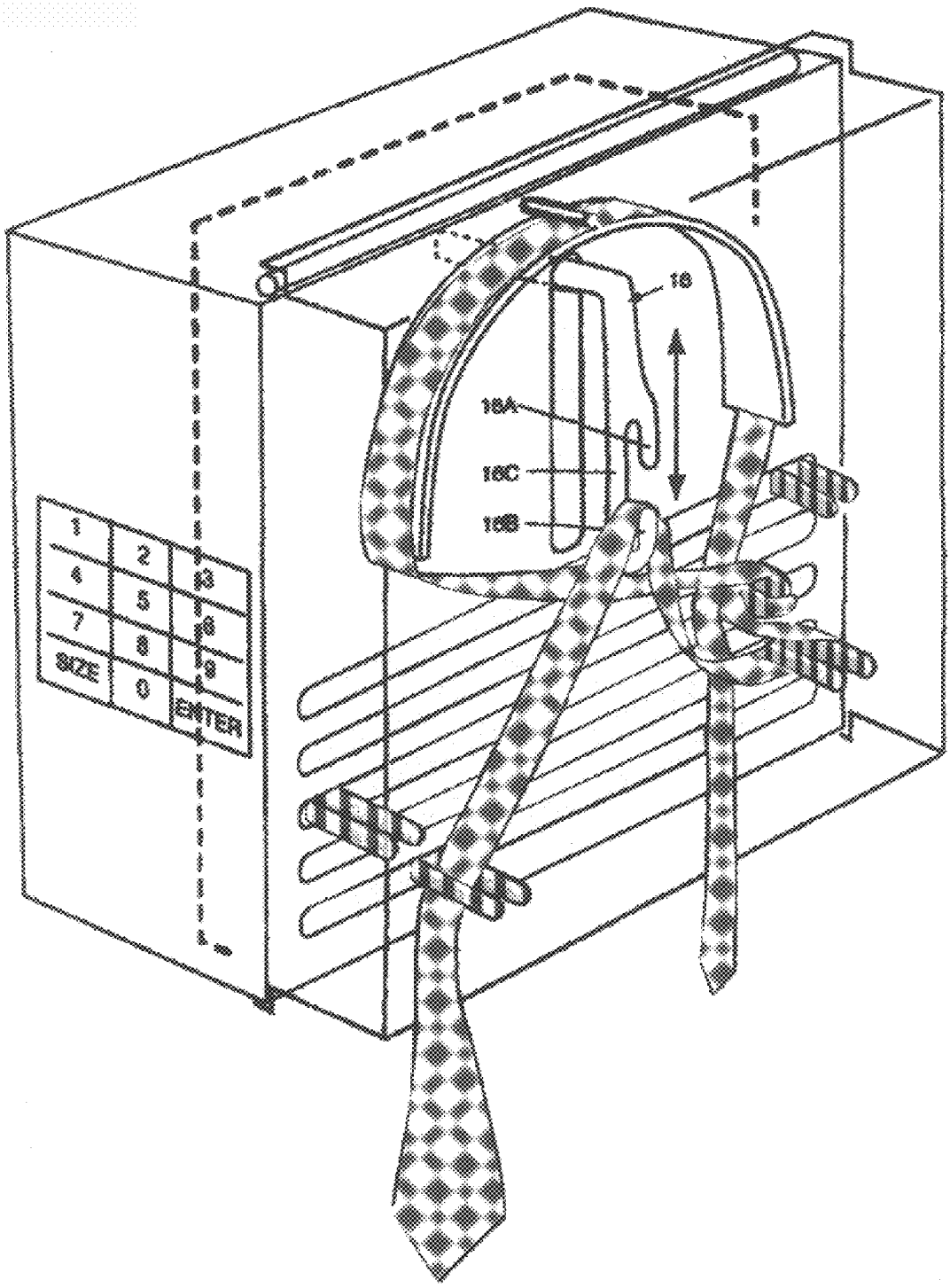
FIG. 5 is a top left perspective view of a necktie knotter (10) exhibiting a tie (20) being knotted therein by second moving (130) the second left peg (14BL) and second right peg (14BR) with the tie right side (20R) therebetween to the left past the tie left side (20L) and thereafter fifth grasping (132) the tie left side (20L) between the fifth left peg (14EL) and fifth right peg (14ER) and thereafter second retracting (134) the fifth left peg (14EL) and fifth right peg (14ER) moving the tie left side (20L) inwardly close to the housing front (12F) while concurrently releasing the tie left side (20L) from the fourth left peg (14DL) and fourth right peg (14DR) and thereafter third moving (36) the fifth left peg (14EL) and fifth right peg (14ER) with the tie left side (20L) therebetween to the left past the tie right side (20R) and thereafter fourth moving (138) the hook (116) downwardly until the tie left side (20L) is engaged within the hook cradle member (16C) while concurrently releasing the tie left side (20L) from the fifth left peg (14EL) and fifth right peg (14ER) forming a loose crossover knot between the tie left side (20L) and the tie right side (20R) and thereafter fourth moving (140) the hook (16) with the tie left side (20L) upwardly and outwardly over the tie right side (20R)
Figure 6:
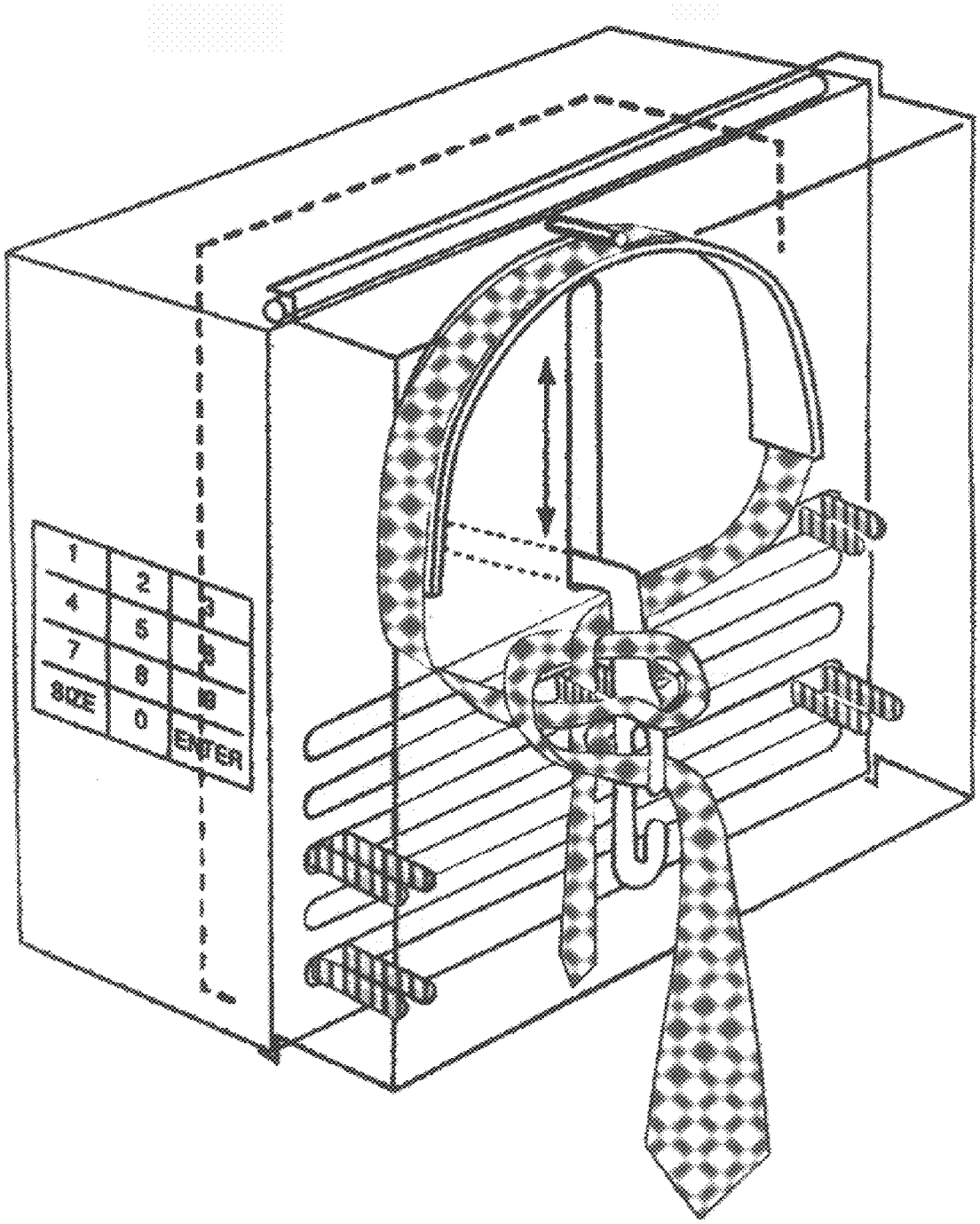
FIG. 6 is a top left perspective view of a necktie knotter (10) exhibiting a tie (20) being knotted therein by fifth moving (142) the hook (16) with the tie left side (20L) downwardly through the loose crossover knot between the tie left side (20L) and the tie right side (20R) until a distal end of the tie left side (20L) clears the loose crossover knot thereby forming a necktie knot.
Figure 6A:
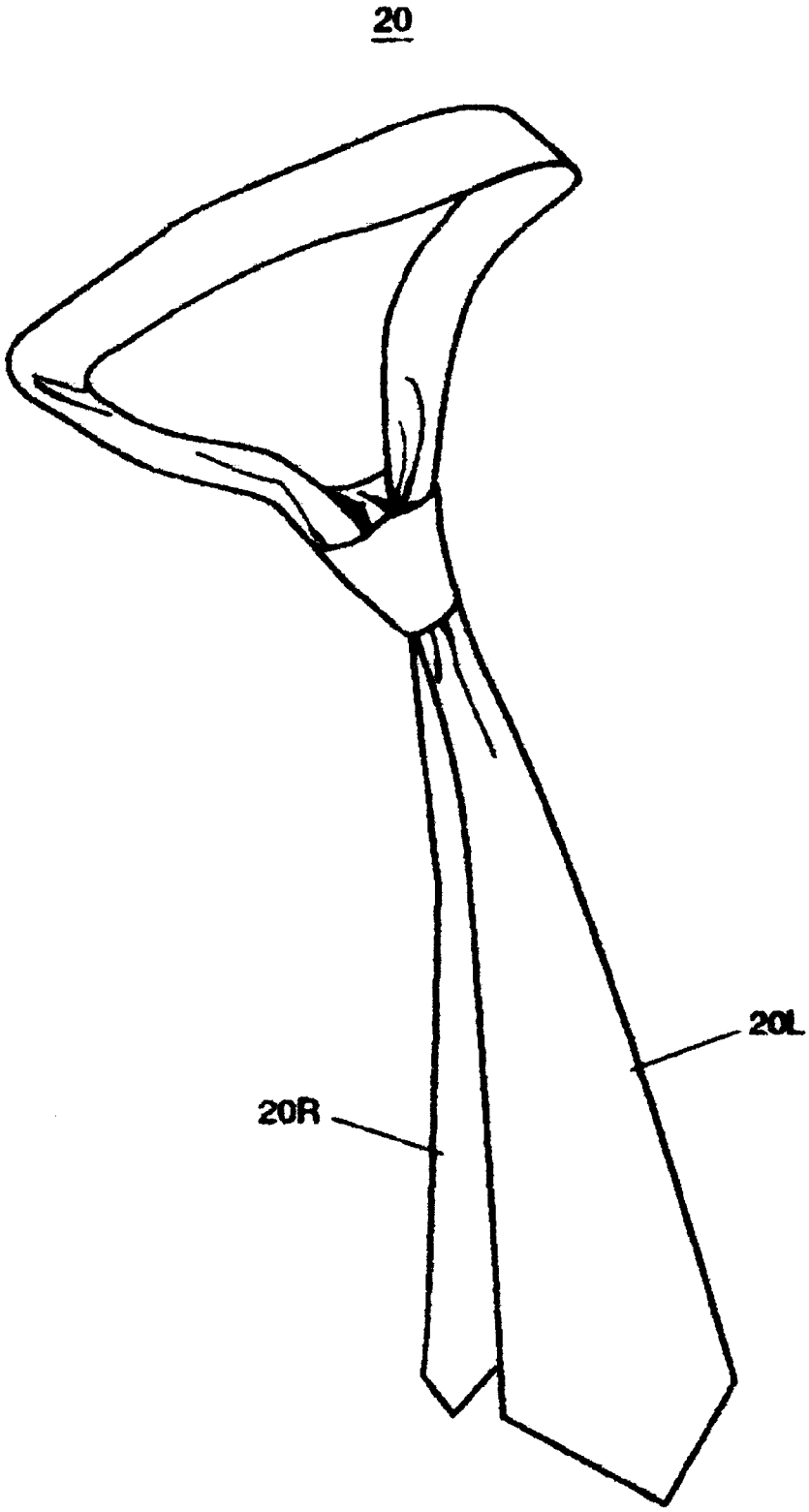
FIG. 6A is a top left perspective view of a knotted tie (20).
Figure 7:
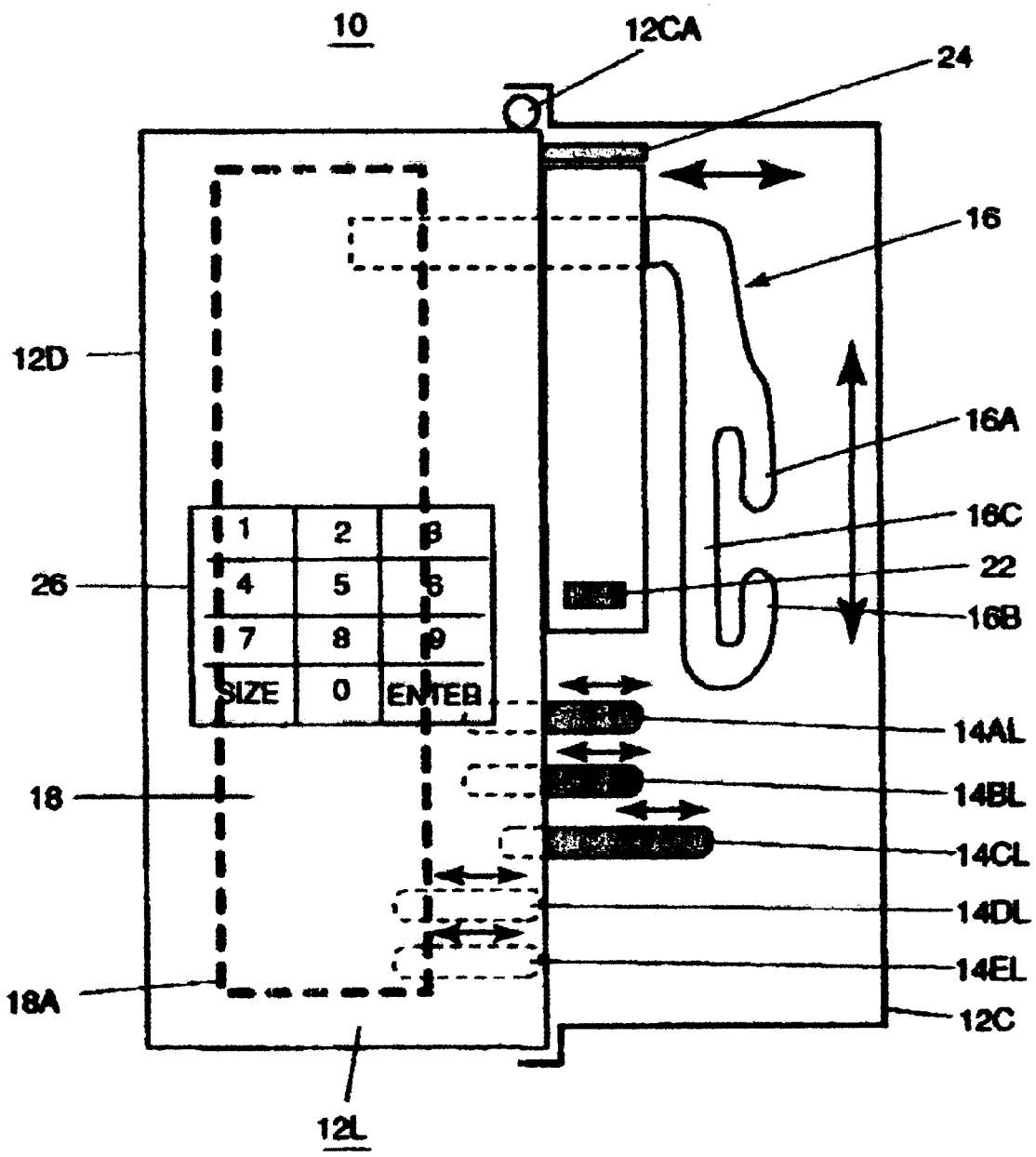
FIG. 7 is a left side view of a necktie knotter (10) exhibiting the plurality of pegs and hook (16) retracting and extending.

Referring to FIG. 1 through FIG. 6A are a top left perspective view of a necktie knotter (10) exhibiting a tie (20) being knotted therein. The necktie knotter (10) comprises a housing (12) which comprises a housing top (12T), housing bottom (12B), housing left (12M), housing right (12R), housing front (12F), housing rear (12D), housing first slot (12G) positioned within the housing front (12F), housing second slot (12H) positioned within the housing front (12F), housing third slot (121) positioned within the housing front (12F), housing four th slot (12J) positioned within the housing front (12F), housing fifth slot (12K) positioned within the housing front (12F), housing sixth slot (12L) positioned within the housing front (12F), and a housing crest (12A) extending outwardly from the housing front (12F).

The necktie knotter (10) further comprises a plurality of paired pegs movably mounted within slots consisting of a retractable slidable first left peg (14AL) and first right peg (14AR) positioned in a housing first slot (12G), a retractable slidable second left peg (14BL) and second right peg (14BR) positioned in a housing second slot (12H), a retractable slidable third left peg (14CL) and third right peg (14CR) positioned in a housing third slot (12I), a retractable slidable fourth left peg (14DL) and fourth right peg (14DR) positioned in a housing fourth slot (12J), a retractable slidable fifth left peg (14EL) and fifth right peg (14ER) positioned in a housing fifth slot (12K).

The necktie knotter (10) further comprises a retractable slidable hook (16) positioned in a housing sixth slot (12L). The hook (16) comprises a hook upper member (16A) and a hook lower member (16B) forming a hook cradle member (16C) therebetween.

The necktie knotter (10) further comprises a motor (18) positioned within the housing (12). The plurality of pegs and hook (16) are retractably and movably connected to the motor (18). The motor (18) comprises a microchip controller containing software which controls the plurality of pegs and hook (16). The motor (18) further comprises a motor cord (18A) electrically connected thereto at one distal end and electrically connected to an AC or DC power source at the opposite distal end. The software within the microchip controller consists of the following steps:

A) placing (112) a tie right side knot point (20RA) of a tie (20) over the housing crest (12A)

B) first grasping (114) a tie right side (20R) of a tie (20) between the second left peg (14BL) and second right peg (14BR), C) first sliding (1 16) the tie right side (20R) to the left under and past a tie left side (20L), D) second grasping (118) a tie left side (20L) between the first left peg (14AL) and first right peg (14AR) and moving to the right over the tie right side (20R), E) third grasping (120) the tie left side (20L) between the third left peg (14CL) and the third right peg (14CR), F) first retracting (122) the third left peg (14CL) and the third right peg (14CR) moving the tie left side (20L) inwardly close to the housing front (12F) while concurrently releasing the tie left side (20L) from the first left peg (14AL) and first right peg (14AR), G) first moving (124) the third left peg (14CL) and the third right peg (14CR) to the left positioning the tie left side (20L) over and behind the tie right side (20R), H) fourth grasping (126) the tie left side (20L) between the fourth left peg (14DL) and the fourth right peg (14DR), I) first extending (128) the fourth left peg (14DL) and the fourth right peg (14DR) moving the tie left side (20L) outwardly from the housing front (12F) while concurrently releasing the tie left side (20L) from the third left peg (14CL) and third right peg (14CR), J) second moving (130) the second left peg (14BL) and second right peg (14BR) with the tie right side (20R) therebetween to the left past the tie left side (20L), K) fifth grasping (132) the tie left side (20L) between the fifth left peg (14EL) and fifth right peg (14ER), L) second retracting (134) the fifth left peg (14EL) and fifth right peg (14ER) moving the tie left side (20L) inwardly close to the housing front (12F) while concurrently releasing the tie left side (20L) from the fourth left peg (14DL) and fourth right peg (14DR), M) third moving (136) the fifth left peg (14EL) and fifth right peg (14ER) with the tie left side (20L) therebetween to the left past the tie right side (20R), N) fourth moving (138) the hook (16) downwardly until the tie left side (20L) is engaged within the hook cradle member (16C) while concurrently releasing the tie left side (20L) from the fifth left peg (14EL) and fifth right peg (14ER) forming a loose crossover knot between the tie left side (20L) and the tie right side (20R), O) fourth moving (140) the hook (16) with the tie left side (20L) upwardly and outwardly over the tie right side (20R), and P) fifth moving (142) the hook (16) with the tie left side (20L) downwardly through the loose crossover knot between the tie left side (20L) and the tie right side (20R) until a distal end of the tie left side (20L) clears the loose crossover knot thereby forming a necktie knot.

The necktie knotter (10) further comprises a power means connected to the motor (18). The power means is optionally battery or AC.

The necktie knotter (10) further comprises an optical reader (22) positioned in the housing crest (12A) and a roller (24) electrically connected to the motor (18) positioned over and adjacent to the housing crest (12A) and a keypad (26) electrically connected to the motor (18). The optical reader (22) is electrically connected to the motor (18) and functions to locate the tie left side (20L) or the tie right side (20R) to move the tie right side knot point (20RA) into the correct position via the roller (24) which rotates moving the tie (20) left or right. The keypad (26) functions to allow a user to enter in their height and length of the tie which determines the correct positioning of the tie right side knot point (20RA).

It will be understood that each of the elements described above, or two or more together, may also find a useful application in other types of constructions differing from the type described above.

While the invention has been illustrated and described as embodied in necktie knotters, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A necktie knotter (10) comprising:

A) a housing (12) which comprises a housing top (12T), housing bottom (12B), housing left (12M), housing right (12R), housing front (12F), housing rear (12D), housing first slot (12G) positioned within the housing front (12F), housing second slot (12H) positioned within the housing front (12F), housing third slot (121) positioned within the housing front (12F), housing fourth slot (12J) positioned within the housing front (12F), housing fifth slot (12K) positioned within the housing front (12F), housing sixth slot (12L) positioned within the housing front (12F), and a housing crest (12A) extending outwardly from the housing front (12F);

B) a plurality of paired pegs movably mounted within slots consisting of a retractable slidable first left peg (14AL) and first right peg (14AR) positioned in a housing first slot (12G), a retractable slidable second left peg (14BL) and second right peg (14BR) positioned in a housing second slot (12H), a retractable slidable third left peg (14CL) and third right peg (14CR) positioned in a housing third slot (121), a retractable slidable fourth left peg (14DL) and fourth right peg (14DR) positioned in a housing fourth slot (12J), a retractable slidable fifth left peg (14EL) and fifth right peg (14ER) positioned in a housing fifth slot (12K);

C) a retractable slidable hook (16) positioned in a housing sixth slot (12L), the hook (16) comprises a hook upper member (16A) and a hook lower member (16B) forming a hook cradle member (16C) therebetween;

D) a motor (18) positioned within the housing (12), the plurality of pegs and hook (16) are retractably and movably connected to the motor (18), the motor (18) comprises a microchip controller containing software which controls the plurality of pegs and hook (16); and E) a power means connected to the motor (18).

2. The necktie knotter (10) as described in claim 1, wherein the motor (18) further comprises a motor cord (18A) electrically connected thereto at one distal end and electrically connected to an AC or DC power source at the opposite distal end.

3. The necktie knotter (10) as described in claim 1 further comprises an optical reader (22) positioned in the housing crest (12A) and a roller (24) electrically connected to the motor (18) positioned over and adjacent to the housing crest (12A) and a keypad (26) electrically connected to the motor (18).

4. A method for tying a necktie knot consisting of the following steps:

A) placing (112) a tie right side knot point (20RA) of a tie (20) over the housing crest (12A)

B) first grasping (114) a tie right side (20R) of a tie (20) between the second left peg (14BL) and second right peg (14BR), C) first sliding (116) the tie right side (20R) to the left under and past a tie left side (20L), D) second grasping (118) a tie left side (20L) between the first left peg (14AL) and first right peg (14AR) and moving to the right over the tie right side (20R), E) third grasping (120) the tie left side (20L) between the third left peg (14CL) and the third right peg (14CR), F) first retracting (122) the third left peg (14CL) and the third right peg (14CR) moving the tie left side (20L) inwardly close to the housing front (12F) while concurrently releasing the tie left side (20L) from the first left peg (14AL) and first right peg (14AR), G) first moving (124) the third left peg (14CL) and the third right peg (14CR) to the left positioning the tie left side (20L) over and behind the tie right side (20R), H) fourth grasping (126) the tie left side (20L) between the fourth left peg (14DL) and the fourth right peg (14DR), I) first extending (128) the fourth left peg (14DL) and the fourth right peg (14DR) moving the tie left side (20L) outwardly from the housing front (12F) while concurrently releasing the tie left side (20L) from the third left peg (14CL) and third right peg (14CR), J) second moving (130) the second left peg (14BL) and second right peg (14BR) with the tie right side (20R) therebetween to the left past the tie left side (20L), K) fifth grasping (132) the tie left side (20L) between the fifth left peg (14EL) and fifth right peg (14ER), L) second retracting (134) the fifth left peg (14EL) and fifth right peg (14ER) moving the tie left side (20L) inwardly close to the housing front (12F) while concurrently releasing the tie left side (20L) from the fourth left peg (14DL) and fourth right peg (14DR), M) third moving (136) the fifth left peg (14EL) and fifth right peg (14ER) with the tie left side (20L) therebetween to the left past the tie right side (20R), N) fourth moving (138) the hook (16) downwardly until the tie left side (20L) is engaged within the hook cradle member (16C) while concurrently releasing the tie left side (20L) from the fifth left peg (14EL) and fifth right peg (14ER) forming a loose crossover knot between the tie left side (20L) and the tie right side (20R), O) fourth moving (140) the hook (16) with the tie left side (20L) upwardly and outwardly over the tie right side (20R), and P) fifth moving (142) the hook (16) with the tie left side (20L) downwardly through the loose crossover knot between the tie left side (20L) and the tie right side (20R) until a distal end of the tie left side (20L) clears the loose crossover knot thereby forming a necktie knot.

* * * * *